US009732703B2

(12) United States Patent
G. R.

(10) Patent No.: US 9,732,703 B2
(45) Date of Patent: Aug. 15, 2017

(54) METHOD, SYSTEM AND APPARATUS FOR SUPPLYING AIR AND FUEL MIXTURE TO A COMBUSTION CHAMBER

(71) Applicant: Bharath Sai Kumar G. R., Tumkur (IN)

(72) Inventor: Bharath Sai Kumar G. R., Tumkur (IN)

( * ) Notice: Subject to any disclaimer, the term of this patent is extended or adjusted under 35 U.S.C. 154(b) by 18 days.

(21) Appl. No.: 14/911,027

(22) PCT Filed: Aug. 22, 2014

(86) PCT No.: PCT/IN2014/000542

§ 371 (c)(1),
(2) Date: Feb. 9, 2016

(87) PCT Pub. No.: WO2015/025337

PCT Pub. Date: Feb. 26, 2015

(65) Prior Publication Data

US 2016/0177876 A1 Jun. 23, 2016

(30) Foreign Application Priority Data

Aug. 23, 2013 (IN) ..... 3742/CHE/2013

(51) Int. Cl.

| | |
|---|---|
| ***F02M 9/00*** | (2006.01) |
| ***F02M 9/127*** | (2006.01) |
| ***F02M 9/10*** | (2006.01) |
| ***F02M 9/02*** | (2006.01) |
| ***F02M 9/06*** | (2006.01) |

(52) U.S. Cl.

CPC ..... *F02M 9/10* (2013.01); *F02M 9/02* (2013.01); *F02M 9/06* (2013.01); *F02M 9/127* (2013.01)

(58) Field of Classification Search

CPC .. F02M 9/10; F02M 9/02; F02M 9/23; F02M 9/026; F02M 9/04; F02M 9/103; F02M 9/106; F02M 9/123; F02M 9/124; F02M 9/125; F02M 9/127; F02M 9/1275; F02M 9/133; F02M 9/14; F02M 9/06

See application file for complete search history.

(56) References Cited

U.S. PATENT DOCUMENTS 1,073,727 A * 9/1913 Atwood ..... F02M 9/127 261/107

1,196,669 A * 8/1916 Lukacsevics ..... F02M 9/127 261/41.4

* cited by examiner

*Primary Examiner* — Jacob Amick

(57) ABSTRACT

In one aspect of the present invention carburetor comprises a hollow first cylinder and a hollow second cylinder. In one embodiment, hollow first cylinder comprising plurality of nozzles formed on the lateral surface and nozzles providing flow path for a fuel to flow from the hollow region to outside of the later surface of the first cylinder. In another embodiment, hollow second cylinder placed on the first cylinder and the axis of the first cylinder and the second cylinder coincide. In another aspect of the present invention, sliding the second cylinder over the first cylinder, and number of nozzles through which fuel flows out increases when the outer cylinder is slide in first direction. In one embodiment, the first cylinder is placed in a first region through which air is sucked into the combustion chamber. In another embodiment, a throttle control operative to increase the engine power, may be coupled to the second cylinder such that increasing throttle pulls the second cylinder in the first direction.

12 Claims, 10 Drawing Sheets

METHOD, SYSTEM AND APPARATUS FOR SUPPLYING AIR AND FUEL MIXTURE TO A COMBUSTION CHAMBER

CROSS REFERENCES TO RELATED APPLICATIONS

This application claims priority from Indian patent application No. 3742/CHE/2013 filed on Aug. 23, 2013 which is incorporated herein in its entirety by reference.

STATEMENT REGARDING FEDERALLY SPONSORED RESEARCH OR DEVELOPMENT

Not Applicable

COPYRIGHT NOTIFICATION

No Copyright Notification

BACKGROUND

Technical Field

Embodiments of the present disclosure relate generally to automotive technology and in particular to supplying air and fuel mixture to a combustion chamber.

Related Art

Often air and/or fuel are ignited in a combustion chamber to generate energy for various purposes. For example, the energy may be used to produce mechanical movement/actions. The air and fuel are mixed in a proportion to generate energy efficiently. In general, devices are used to control the supply of the air and fuel to the combustion chamber thereby controlling the energy generated. Carburetor is an example device that blends air and fuel for an internal combustion engine. Corroborator generally produces an explosive mixture of vaporized fuel and air. FIG. 1A illustrates the conventional carburetor arrangement. FIG. 1B illustrates the cross section of conventional carburetor arrangement. The prior carburetor is shown comprising elements that include venturi 105, outer air inlet 110, combustion chamber 115, throttle valve diaphragm 120, throttle slide 125, needle jet 130, jet needle 135, pilot air jet 140, floater 145, float valve 150, main jet 155, pilot jet 160, pilot mixture screw 165, throttle plate 170, chock plunger 175, float bowl 180 and spring 185. Each of the elements is described in further detail.

Venturi 105 is a tube connecting outer air inlet 110 with combustion chamber 115 of engine. The throttle valve diaphragm 120 and throttle slide 125 are interconnected. A spring 185 is placed in the hollow space provided by throttle valve diaphragm 120 and throttle slide 125. The spring 185 is tightly coupled with throttle valve diaphragm 120 and throttle slide 125. The front end of accelerator wire (cable) is connected to throttle hand bar. The rear end of accelerator wire along with spring is attached to the flat end surface of jet needle 135 along the throttle slide 125. The throttle plate 170 is used to control the flow of air in the venturi 105 and creates a vacuum at throttle valve diaphragm 120. The butterfly valve is operated to allow vacuum at throttle valve diaphragm 120.

The fuel from fuel tank is a mixture of fuel and oil. The flow of fuel to float bowl 180 is controlled by floater 145 and float valve 150. The float valve 150 is placed on the floater 145. The level of fuel increases in float bowl 180 and induce the floater 145 to gradually close the inlet of float bowl 180 through float valve 150. Also, bendable float valve 150 is used to adjust the level of fuel in the float bowl 180. During the course of starting the engine, choke plunger 175 is pulled and a small volume of fuel is flown into the venturi 105. Jets are operated to supply continuous and controlled flow of fuel from float bowl into the venturi 105. Also, secondary intake is opened and outer air (air intake) is sucked by the pilot air jet 140 into the venturi 105. The pilot jet 160 is opened to allow small amount of fuel, which is flown into venturi 105. Outer air and fuel is mixed and flown at the pilot mixture screw 165. Flow of air and fuel mixture is adjusted by pilot mixture screw 165. The choke plunger 175 sprays out extra fuel. Then, choke plunger 175 is closed to attain idling state of engine. During the throttle, the throttle plate 170 is opened to create a vacuum space (passage) at throttle valve diaphragm 120. The vacuum passage retracts the throttle valve diaphragm 120. The jet needle 135 attached with throttle slide 125 is raised to open main jet 155 and needle jet 130. The fuel from float bowl 180 is passed through main jet 155 and needle jet 130. Air is flown from outer air inlet 110 of engine (primary). The air and fuel is mixed and passed towards the combustion chamber 115. The angle of throttle plate 170 determines the positions of throttle slide 125, amount of fuel to be sucked and air to be mixed at the venturi 105. Also, size of main jet 155 and needle jet 130 determines amount of fuel flow into the venturi 105. When the throttle is high, the throttle plate 170 is fully opened and vacuum occupies the passage of throttle valve diaphragm 120. And, throttle slide 125 and needle jet 130 are raised high. The large amount of air and fuel is passed through the venturi 105 and passed to the combustion chamber 115. During idling of engine, the throttle plate 170 is closed, throttle slide 125 retorts to original position which closes the needle jet 130 and restricts air from outer air inlet 110. The operation of the conventional carburetor is further described in the book titled "Holley: Carburetors, Manifolds and Fuel Injection", authored by Bill Fisher which is incorporated herein by reference. Details of an example valve are described in India Patent Application number 2664/CHE/2013, which is incorporated herein by reference.

SUMMARY

In one aspect of the present invention carburetor comprises a hollow first cylinder and a hollow second cylinder. In one embodiment, hollow first cylinder comprising plurality of nozzles formed on the lateral surface and nozzles providing flow path for a fuel to flow from the hollow region to outside of the later surface of the first cylinder. In another embodiment, hollow second cylinder placed on the first cylinder and the axis of the first cylinder and the second cylinder coincide. In another aspect of the present invention, sliding the second cylinder over the first cylinder, and number of nozzles through which fuel flows out increases when the outer cylinder is slide in first direction. In one embodiment, the first cylinder is placed in a first region through which air is sucked into the combustion chamber. In another embodiment, a throttle control operative to increase the engine power, may be coupled to the second cylinder such that increasing throttle pulls the second cylinder in the first direction.

DETAILED DESCRIPTION OF THE PREFERRED EXAMPLES

Several embodiments are described below, with reference to diagrams for illustration. It should be understood that numerous specific details are set forth to provide a full understanding of the invention. One skilled in the relevant art, however, will readily recognize that embodiments may be practiced without one or more of the specific details, or with other methods, etc. In other instances, well-known structures or operations are not shown in detail to avoid obscuring the features of the invention.

Figure 1B:
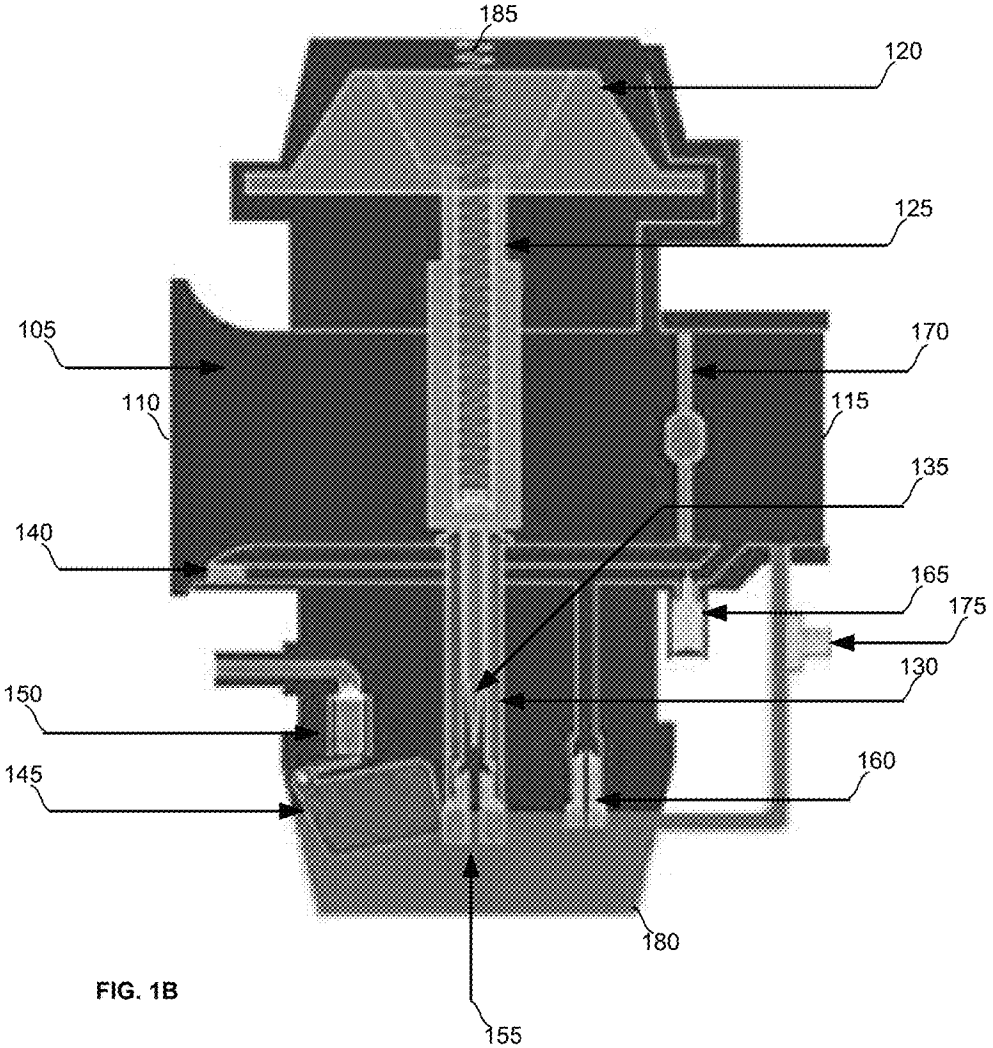
FIG. 1B illustrates the cross section of prior carburetor arrangement.
Figure 1A:
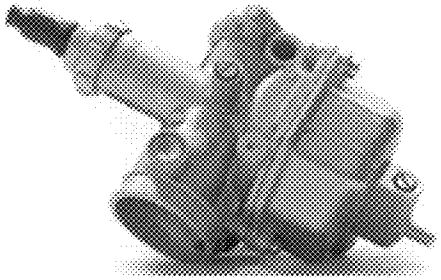
FIG. 1A illustrates the prior carburetor arrangement.
Figure 2:
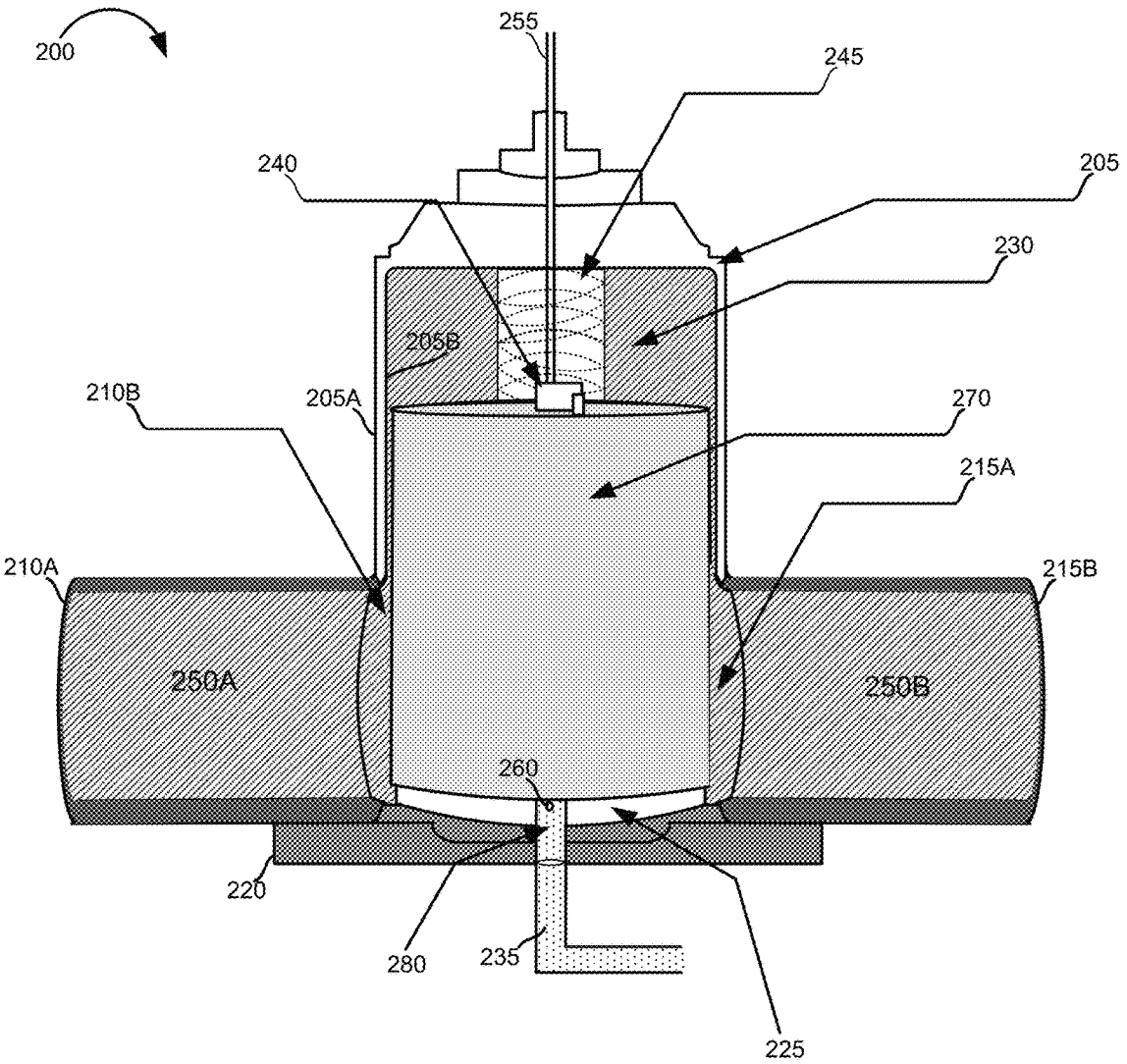
FIG. 2 is an example carburetor arrangement for supplying air and fuel mixture to a combustion chamber in an embodiment of the present invention.

FIG. 2 is an example carburetor arrangement for supplying air and fuel mixture to a combustion chamber in an embodiment of the present invention. The example carburetor 200 is shown comprising a casing 205, air intake opening 210A, combustion chamber outlet 215B, solid base 220, fuel inlet 235, clamp 240, spring 245, venturi 250A and 250B, throttle wire 255, a nozzle 260, outer cylinder 270, and a inner cylinder 280. Each component is described in further detail below.

The casing 205 provide suitable strength and shape for efficient carburetor operation. The casing may be shaped as curved, cylindrical, etc., and may be fabricated using any known technique such as foundry, casting etc. A suitable material such as aluminium, and/or other composite material may be used for fabricating the carburetor. The casing 205 is shown comprising an inner wall 205B and an outer wall 205A. The casing 205 may provide inverted 'T' shaped structure for the carburetor operation. The carburetor casing 205 comprises venturi 250A and 250B, mixing region 225 (mixing area or mixing chamber), and control area 230 with corresponding four openings.

The two openings in the outer wall 205A are air intake opening 210A and combustion chamber outlet 215B. The venturi 250A connects the air intake opening 210A and inner opening 210B. The venturi 250B connects inner opening 215A and combustion chamber outlet 215B. The third opening is on the top and may be used for throttle wire 255 which induces an action in the control area 230 for controlling the fuel and air quantity in the carburetor mixing region 225. The fourth opening at the bottom may be used to receive the fuel. Additionally, the casing 205 of carburetor may be constructed to protect the other carburetor components from external force/impacts.

Air intake opening 210A operates as an inlet for external air into the carburetor. The Air intake 210A supplies air for mixing in the mixing region 225 of the carburetor. The air from air intake opening 210A passes through venturi 250A and enters the mixing region 225 through inner opening 210B on the inner wall 205B of the casing 205.

The mixer region 225 receives the fuel through the inner cylinder nozzles 260. During suction cycle, the air and the fuel are mixed due to suction pressure in the mixer region 225. The mixture (combination of air and fuel) is sucked into the combustion chamber (not shown) through the inner opening 215A, venturi 250B and combustion chamber outlet 215 B. Appropriate air filters are attached to the air intake opening 210A of the carburetor to remove dirt, dust in external air. The shape of air intake opening 210A may be cylindrical. Combustion chamber (connected to combustion chamber outlet 215) is a component/part of an engine. Also, it is the region in which air and fuel mixture is ignited (burnt) to produce energy. The energy is transferred into mechanical force to drive a vehicle.

Solid base 220 is flat surface which supports the lower part of carburetor. In one example, the fuel inlet 235 of carburetor is made through the solid base 220.

The inner cylinder 280 and outer cylinder 270 together operate to control the flow of fuel mixture in to the combustion chamber. The outer cylinder 270 slides over the inner cylinder 280 during the control operation.

Inner cylinder 280 is hollow cylinder with inner and outer lateral curved surface. The inner hollow region of the inner cylinder 280 is coupled to the fuel inlet 235 such that the fuel flows into the hollow region of inner cylinder 280. The inner diameter of the inner cylinder 280 and the outer diameter of the inner cylinder 280 may be adjusted to give desired thickness and strength to the inner cylinder 280. Further, the outer diameter of the inner cylinder 280 may be adjusted to suite the size of the carburetor mixing region 225, quantity of fuel to be released, etc. The inner cylinder 280 comprises plurality of holes made though inner surface to outer surface (referred to as nozzles 260) to release the fuel in the hollow region into the mixer region 225. In one embodiment, the inner cylinder 280 is shown mounted vertical or perpendicular to the direction for air flow or venturi 250A and 250B. Alternatively, the inner cylinder 280 may be mounted in other suitable direction. The casing 205 may be molded accordingly. The inner cylinder 280 may be closed or sealed on the top side confining the fuel to flow out (released) only through the nozzles 260.

Outer cylinder 270 is hollow cylinder with inner and outer lateral curved surface. The inner surface of the outer cylinder 270 is coupled with the outer surface of the inner cylinder 280 such that it reciprocates with the inner cylinder 280. The outer cylinder 230 is designed invariably to inhabit or house the inner cylinder 280 such that, the axis of inner cylinder 280 and outer cylinder 270 are coincide. The outer diameter of the outer cylinder 270 is selected such that it occupies the mixing region 225 and slide up and down in the control area 230. Alternately, the outer diameter of the outer cylinder 270 is selected such that it closely couples with inner wall 205B of carburetor and slides up and down with support of the inner wall 205B in the control area 230.

The inner diameter of the outer cylinder 270 is selected such that the outer surface of the inner cylinder 280 and inner surface of the outer cylinder 270 are coupled together. For example, when the inner cylinder 280 is completely covered by the outer cylinder 270, the fuel in the inner cylinder 280 is prevented from flowing out of the inner cylinder 280. Accordingly, fuel flows out of the inner cylinder 280 when the outer cylinder 270 is slides up exposing one or more nozzles 260 to the mixing region 225.

Further, when the outer cylinder 270 is placed or pushed-down completely to the mixing region 225, the outer cylinder 270 covers or closes inner opening 210B and 215A thereby preventing airflow through the venturi 250A and 250B.

The outer cylinder 270 may be closed or sealed on the top side such that the fuel is prevented from escaping though outer cylinder 270. The top surface of the outer cylinder 270 is coupled to the throttle wire 255 (referred to as accelerator wire) such that the throttle or acceleration action (throttle control) causes the movement of the outer cylinder 270 along the axis of the cylinders.

Fuel inlet 235 is a pipe connecting the fuel tank (not shown) and inner cylinder 280. The fuel inlet 235 may be connected at the bottom of inner cylinder 280 as shown in FIG. 2 in one embodiment. Fuel from fuel tank is supplied to the inner cylinder 280 through fuel inlet arrangement.

Clamp 240 is a small connective part mounted on outer cylinder 270. The clamp 240 may be attached with throttle wire 255 of vehicle. The clamp 240 may use a locking mechanism to hold the throttle wire 255. Also, the clamp 240 may sustain the inward and outward pressure on throttle wire.

Spring 245 coupled in between inner wall 205B of carburetor and upper surface of upper cylinder 270. The spring 245 exert pressure pushing the outer cylinder 270 to the mixing region 225. Thus, when the throttle is operated the outer cylinder 270 is lifted thereby compressing the spring 245. Also, when the spring 245 expands (upon release of the throttle), the outer cylinder 270 is pushed completely till the solid base 220.

Throttle wire 255 is connected with clamp 240 mounted on outer cylinder 270. The other end of throttle wire 255 may be connected to the accelerator grip/control of vehicle. The accelerator control is operated to provide a movement on outer cylinder 270 through throttle wire 255 and clamp 240.

Nozzle 260 is small opening in the inner cylinder 280. In one embodiment, the inner cylinder 280 is perforated to craft a nozzle 260. The size and shape of nozzle 260 may be designed to suite the release of the fuel. The nozzle 260 is internally connected with hollow space of inner cylinder 280. The nozzle 260 streams the fuel to the mixing region 225. The outer surface of inner cylinder 280 is covered by hollow outer cylinder 270 which closes the nozzle 260 of inner cylinder 280. Similarly, a number of nozzles 260 are crafted on the outer surface of inner cylinder 280.

Figure 3B:
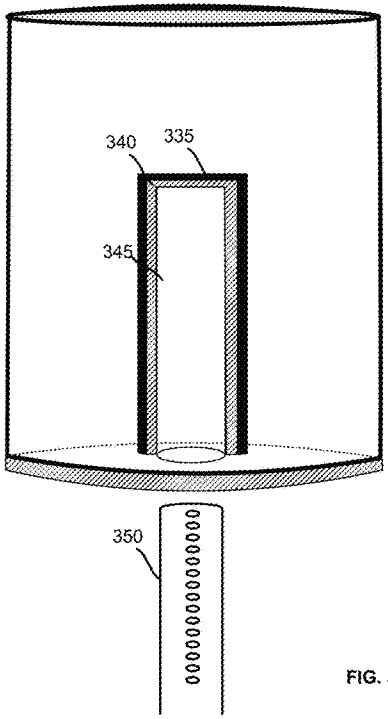
FIG. 3B illustrates the size and shape of example outer cylinder depicting the inner hollow region.
Figure 3A:
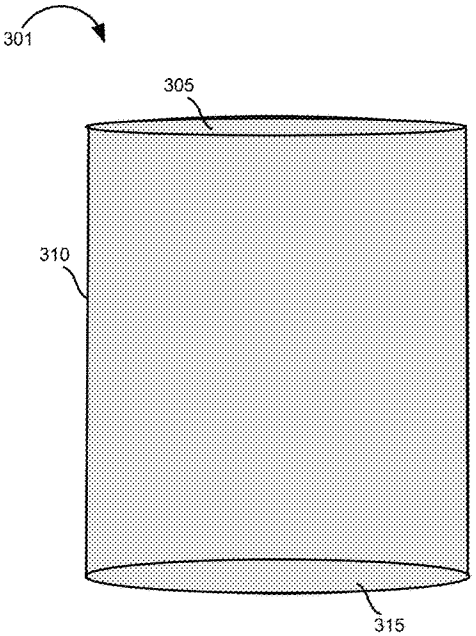
FIG. 3A illustrates the size and shape of an example outer cylinder in one embodiment.

FIG. 3A illustrates the size and shape of an example outer cylinder 301 in one embodiment. The outer cylinder 301 is shown with upper surface 305, lower surface 310 with lateral curved surface 315.

The upper surface 305 of outer cylinder 301 may be flat and circular. In one embodiment, outer cylinder 301 is made of metal etc. In another embodiment, the clamp is mounted in perpendicular to upper surface 305. Also, a holder may be crafted to hold the lower part of spring.

The lower surface 310 of outer cylinder 301 may be circular, have an opening substantially equal to the inner diameter of the outer cylinder 301 to accept the inner cylinder of substantially of same outer diameter. The lateral or curved surface 315 covers area of the cylinder and surface area connects upper surface 305 and lower surface 310 of outer cylinder 301. The hollow surface of outer cylinder 301 may be matched with lateral surface area of inner cylinder. The lateral or curved surface area of outer cylinder 301 is determined through the equation $2\pi rh$, and also the total surface area of outer cylinder 301 is determined through the equation $2\pi r(r+h)$, where 'r' is the radius of any of upper surface 305 or lower surface 310 and 'h' is the height of the outer cylinder 301.

FIG. 3B illustrates the size and shape of example outer cylinder 301 depicting the inner hollow region 345. In one embodiment, as shown there the hollow region 345 is designed to accept the example inner cylinder 350. The inner surface of the outer cylinder 301 is shown laminated with a material that prevents leakage of the fuel out of the inner cylinder 350. The lamination 340 may be any viscous material, rubber, or other material used for providing airtight coupling. The layer 335 is an adhesive material used to attach the lamination to the inner surface.

FIG. 3C to FIG. 3G illustrates a view of varieties of inner cylinder with several fuel release nozzle designs (355, 360, 365, 370 and 375), in one embodiment. The FIG. 3C to 3G also illustrate the size, shape, position and arrangement of nozzles (355, 360, 365, 370 and 375) on the inner cylinder 350.

In one embodiment, the arrangement of nozzles (355, 360, 365, 370 and 375) in inner cylinder 350 may determine the volume of fuel (per unit length of the movement of the outer cylinder) that may be released into the mixing region through the nozzles. Also, the release of fuel is directly proportional number of nozzles exposed to the mixing region. In another embodiment, the lower nozzles may have larger diameter and upper nozzles may have smaller diameter or vice versa. In another embodiment, the arrangement of nozzles (355, 360, 365, 370 and 375) may be of circular, squared, rectangular shapes to improve the control of flow of fuel through nozzles.

Following paragraph describes the example volume of fuel released from the inner cylinder through nozzle.

Figure 3C:
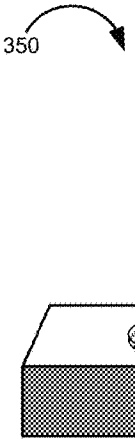
FIG. 3C to FIG. 3G illustrates a view of varieties of inner cylinder with several fuel release nozzle designs in one embodiment.
Figure 3C:
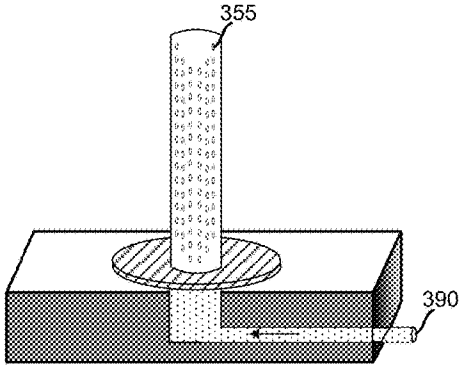

FIG. 3C also illustrates a thinner inner cylinder connected with fuel pipe 390 in one embodiment. The fuel pipe 390 supplies the fuel from fuel tank to the thinner inner cylinder. The nozzles are arranged in parallel with thinner inner cylinder to spray the fuel on the venturi. Also, the outer cylinder is operated upwards to allow the perforated nozzles to release the fuel to the mixing region 225.

Figure 3D:
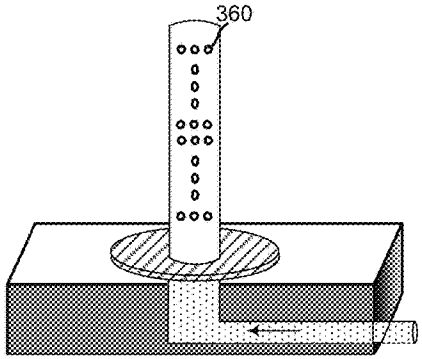
Figure 3E:
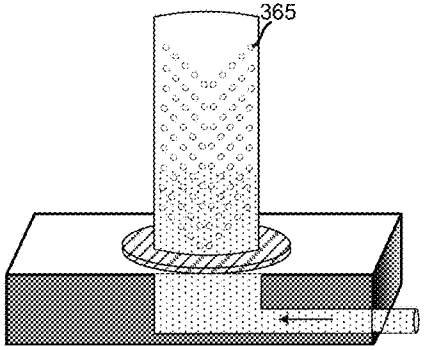
Figure 3F:
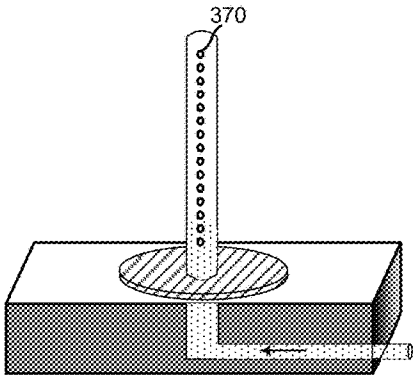
Figure 3G:
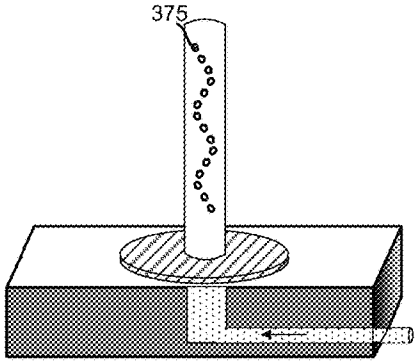

FIG. 3D also illustrates thin inner cylinder with a customizable nozzle arrangement 360 in one embodiment. FIG. 3E illustrate broad inner cylinder with fuel and nozzle arrangement 365 to release more fuel into the venturi. FIG. 3F also illustrates inner cylinder with fuel and narrower nozzle arrangement 370 to release less fuel into the venturi. FIG. 3G illustrates narrow inner cylinder which releases less fuel through the narrow nozzle arrangement 375.

Figure 4C:
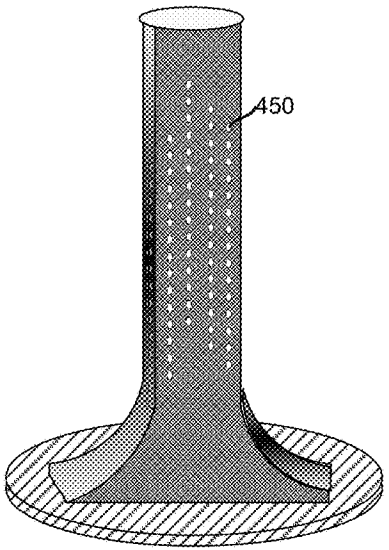
FIG. 4C illustrates example three dimensional view of inner cylinder.
Figure 4B:
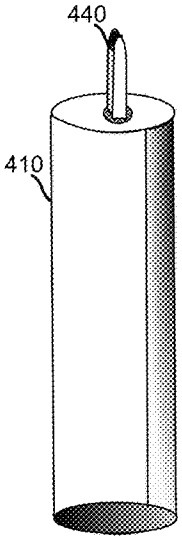
FIG. 4B illustrates example three dimensional view of outer cylinder with clamp.
Figure 4A:
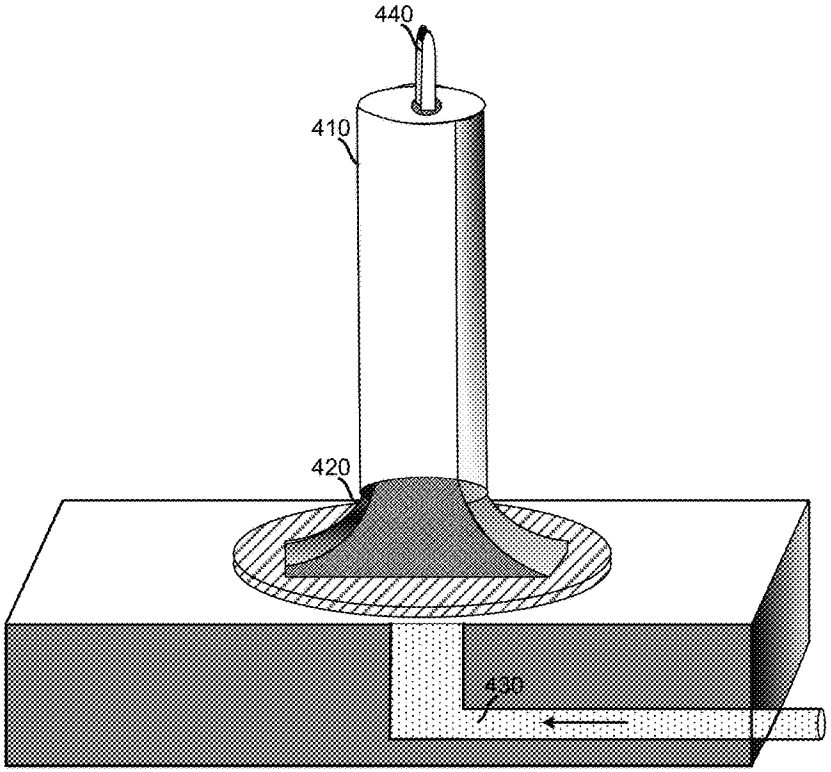
FIG. 4A illustrates example three dimensional arrangement of outer and inner cylinder.

FIG. 4A illustrates example three dimensional arrangement of outer and inner cylinder. The figure is shown with outer cylinder 410 with inner cylinder 420. The fuel inlet 430 is connected to the inner cylinder 420. The fuel is flown into the inner cylinder 420. The clamp 440 is shown mounted on outer cylinder 410 for coupling to throttle cable or other actuators.

FIG. 4B illustrates example three dimensional view of outer cylinder 410 with clamp 440. FIG. 4C illustrates example three dimensional view of inner cylinder 420. The inner cylinder 420 is shown with number of nozzles 450. The nozzles 450 are arranged on all sides of inner cylinder 420. The fuel from inner cylinder is released through the nozzles 450.

FIG. 5 to FIG. 9 illustrates the controlling supply of air and fuel mixture to a combustion chamber in one embodiment. The operation of carburetor is described with the outer cylinder 270 and inner cylinder 280 in detail below.

Figure 5:
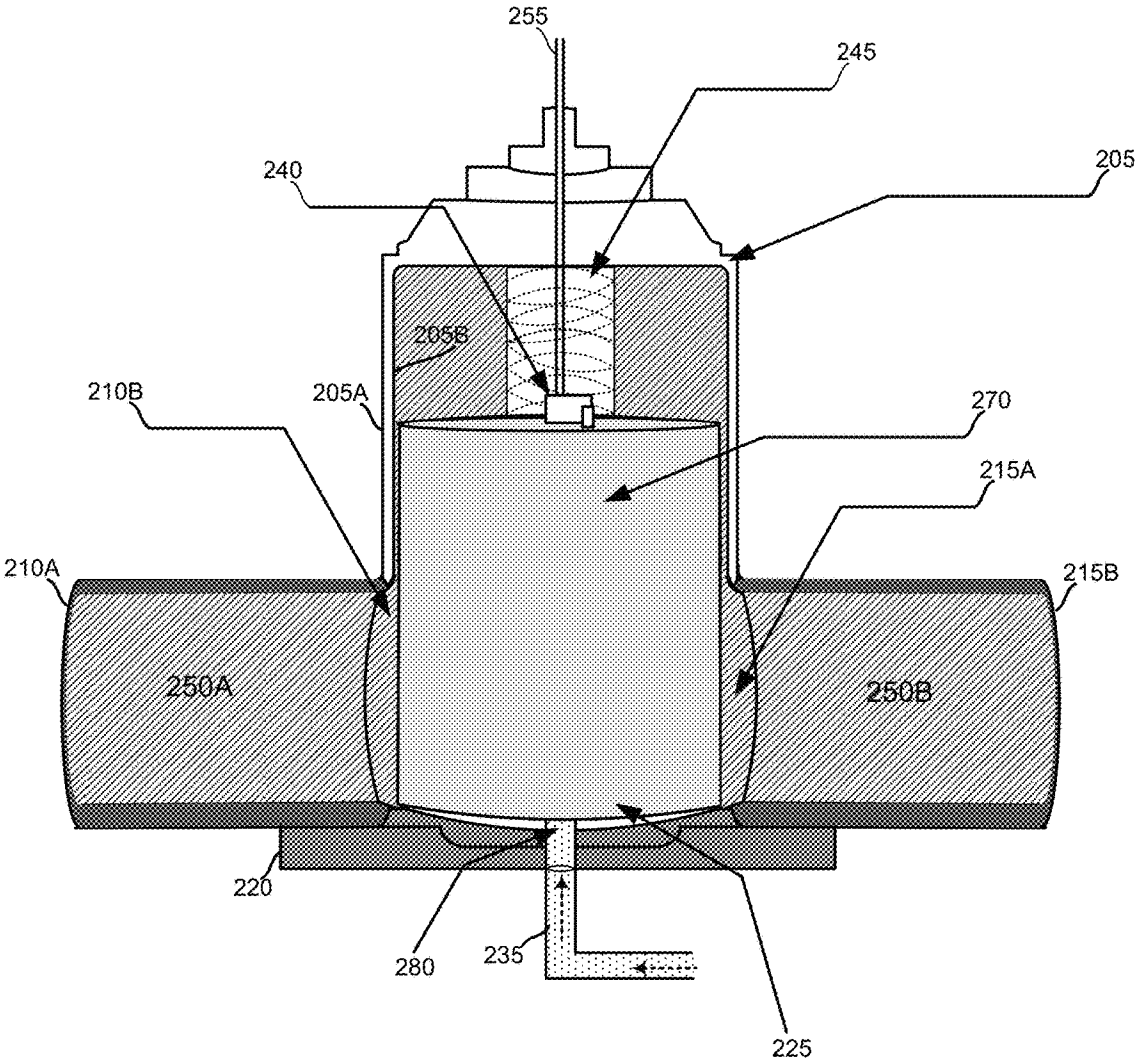
FIG. 5 to FIG. 9 illustrates the controlling supply of air and fuel mixture to a combustion chamber in one embodiment.

FIG. 5 illustrates one of the steady sate of the carburetor. In this state fuel and air are not drawn into the carburetor mixing region 225. The air and fuel mixture is not supplied to the combustion chamber thereby the energy is not generated in the combustion chamber. During this phase the fuel may flow from fuel tank to the hollow space or region of the inner cylinder 280. The outer cylinder 270 is completely pressed down by the spring 245 closing all the nozzles 260 in the inner cylinder 280 and also closing the inner openings 210B and 215A. Thus, both air and fuel are prevented from entering the mixing region 225. For example outer cylinder 270 prevents the flow of fuel out of the nozzles 260 and blocks the air passage through venturi 250A by closing the opening 210B.

The components outer cylinder 270, spring 245, and throttle wire 255 may be operated to start the engine and carburetor. The throttle wire 255 may be initially triggered to start the engine which is coupled with carburetor. The throttle wire 255 is moved upward to trigger the fuel ignition process.

Figure 6:
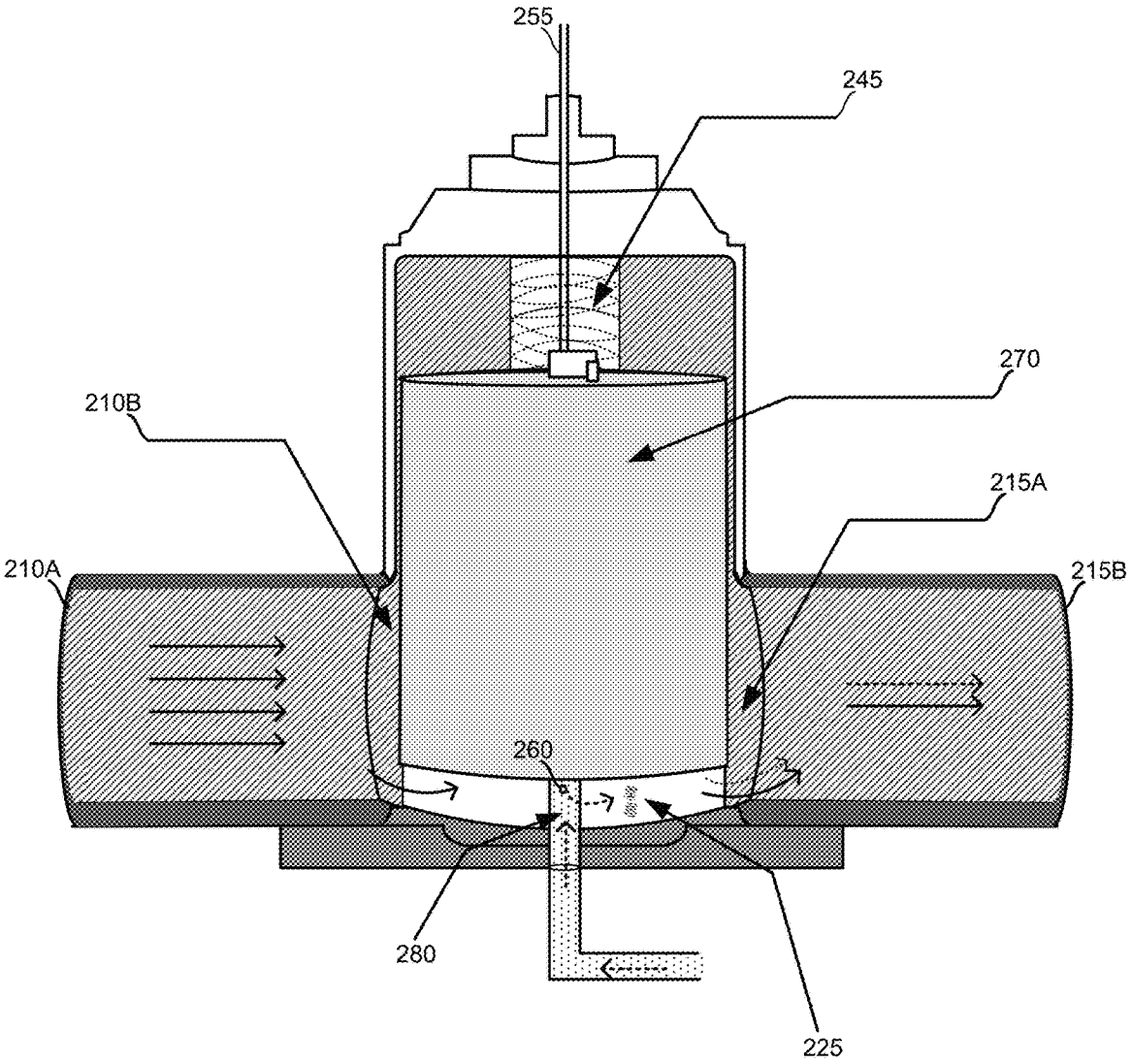

FIG. 6 illustrates another state of the carburetor in which fuel ignition process is started in one embodiment. In this stage, the operating throttle wire 255 lifts the outer cylinder 270 to the first stage with the help of mounted clamp 240. The spring 245 may control the free upward movement of outer cylinder 270. Also, the spring 245 is compressed and outer cylinder 270 is lifted. Due to lifting of the outer cylinder 270, a small volume of air is allowed to flow into the mixing area 225. Similarly, the lifting the outer cylinder 270 exposes a predetermined number of holes or nozzles 260, thereby allowing fuel to flow out of nozzles 260 (thus fuel enter into the mixing area 225) of the inner cylinder 225. As shown there, the bottommost nozzle(s) 260 of inner cylinder 280 may be opened to release the fuel. In another embodiment, multiple nozzles 260 may be opened at the same time to flow more fuel to the mixing area 225. In another embodiment, appropriate size and shape of nozzles 260 may be selected to allow a predetermined quantity of flow of fuel into the mixing area 225.

During the suction cycle, the air is sucked from air intake opening 210A through venturi 250A and mixed with the fuel collected in the mixing region 225 and the air and fuel mixture is then sucked into the combustion chamber through the venturi 250B. In another embodiment, fuel and air is mixed at venturi 250B of carburetor and passed to combustion chamber of engine.

The lifting of the outer cylinder 270 may be caused using any known mechanism when engine starts. A definite volume of fuel and air may be continuously flown from nozzle 260 and air intake respectively to combustion chamber in order to maintain the active ignition state of engine (referred to as idling).

In one embodiment, when the throttle wire 255 is released the outer cylinder 270 may move downwards by decompressing action of the spring 245. In one embodiment, the outer cylinder 270 reaches a predetermined position (example position as in FIG. 6), (idling state), in which a minimum number of nozzles 260 of inner cylinder 280 are opened and a corresponding minimum air flow is maintained. This fuel and air mixture is flown to combustion chamber which may keep engine ON or maintains "ON" state of engine. When the ignition is turned off, the outer cylinder 270 may be further moved down to close all the nozzles 260 of inner cylinder 280 and air path as in FIG. 5.

Figure 7:
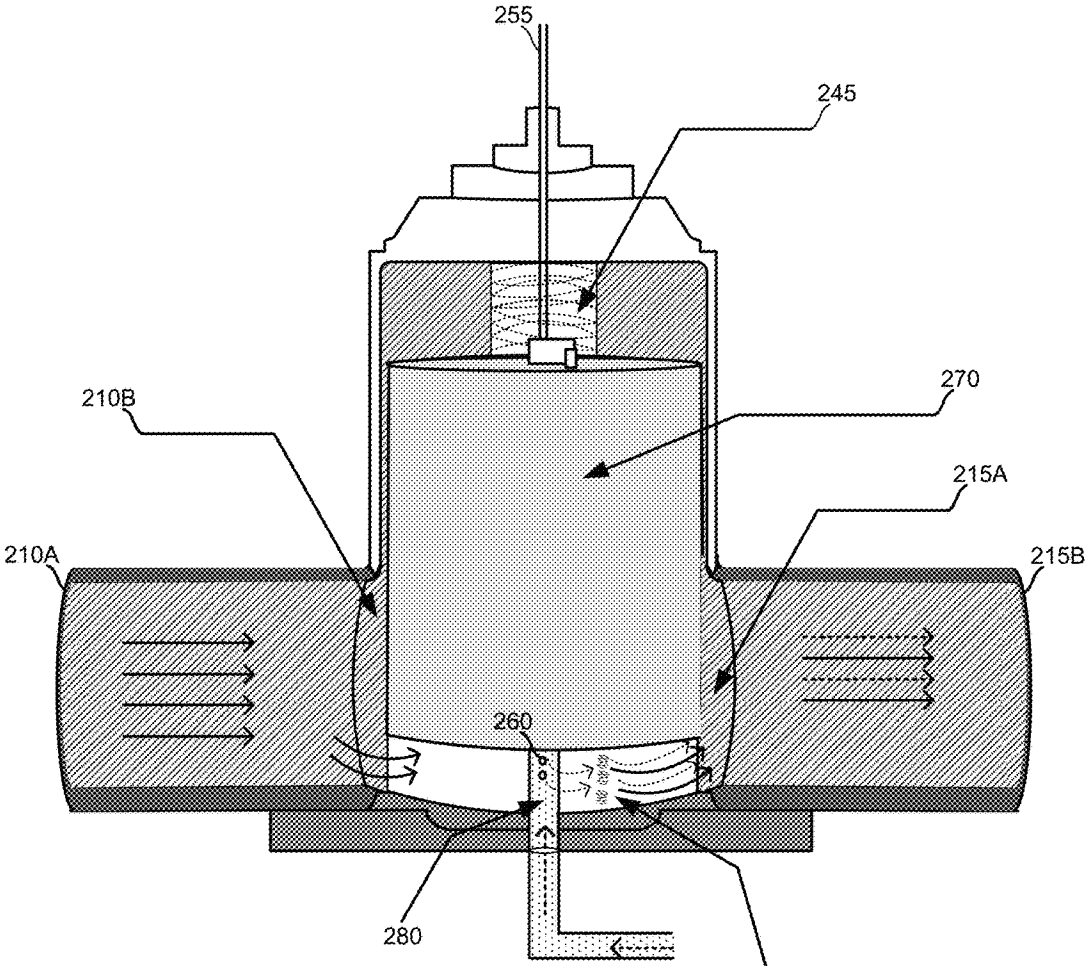
Figure 8:
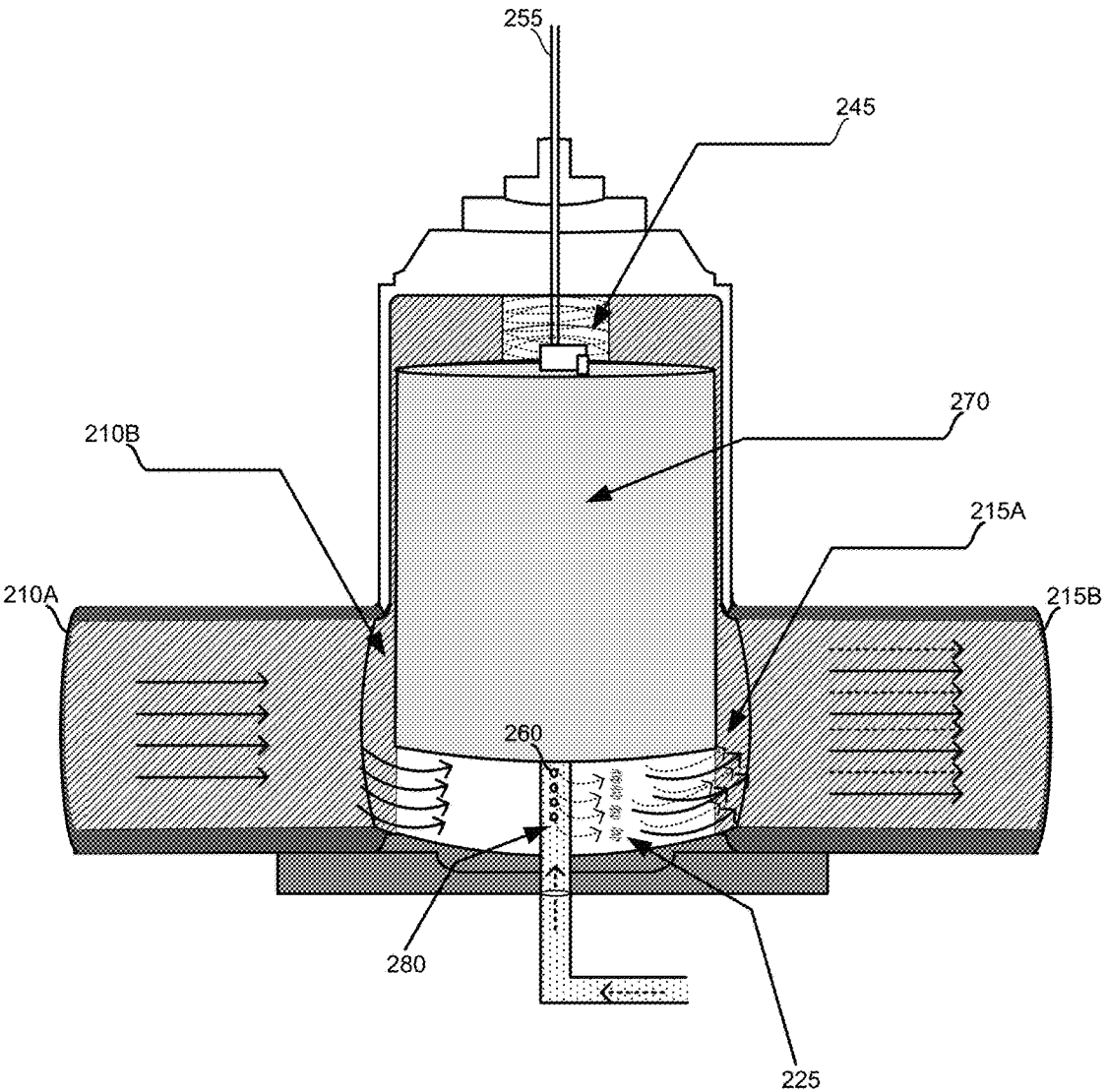
Figure 9:
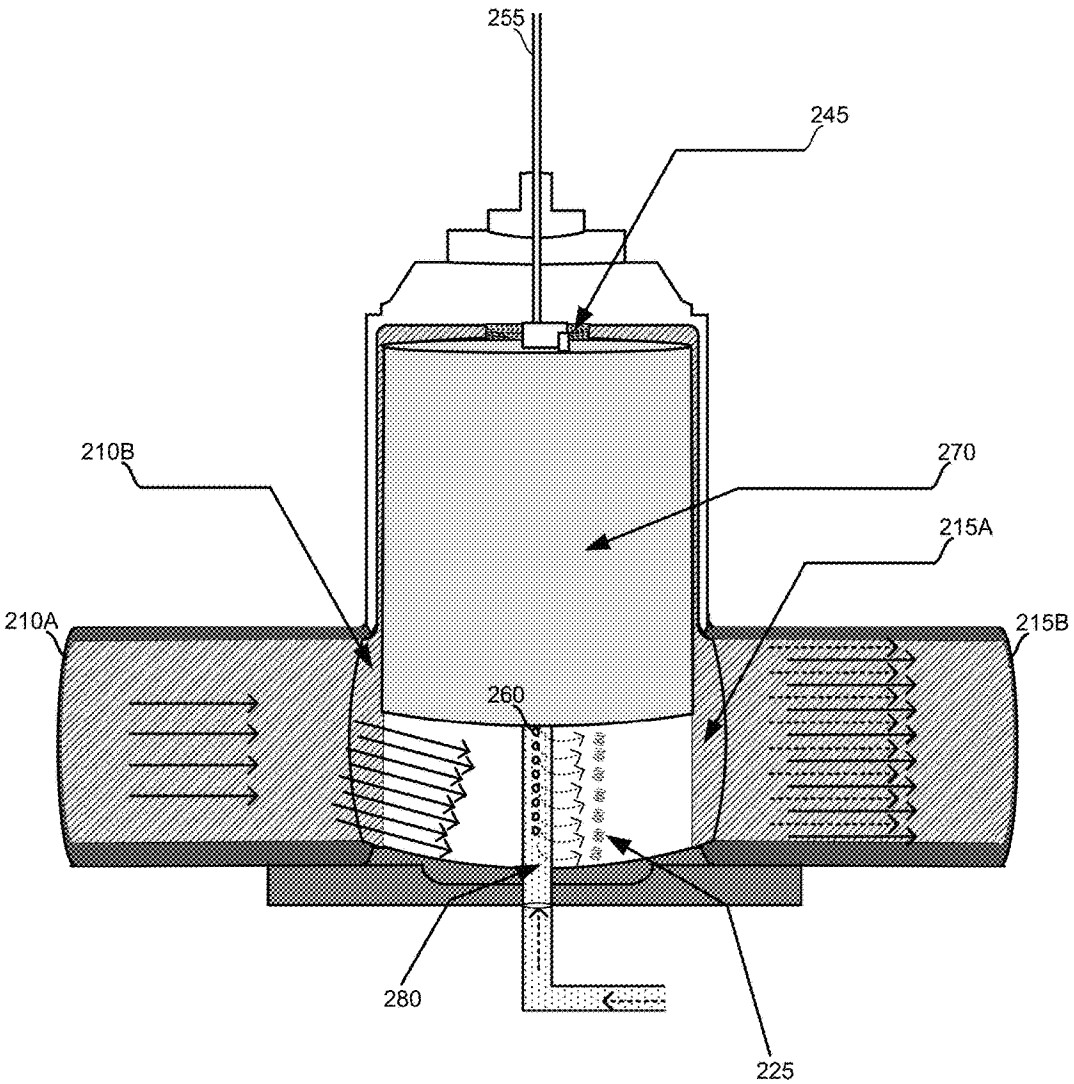

FIGS. 7, 8 and 9 illustrates the manner in which the quantity of the fuel and air is controlled by operation of the outer cylinder 270. As shown in the figures, the outer cylinder 270 is lifted higher with higher throttle. Accordingly, corresponding number of the nozzles 260 and area of inner opening 210B are exposed. Thus, fuel and air quantity are increased proportional to pulled height of the outer cylinder (which is proportional to throttle). Thus, the FIG. 7 through 9 illustrates mechanism for increasing the supply of fuel and air mixture in a definite proportion to the combustion chamber. On the other hand, the FIG. 9 through 7 may illustrate the mechanism for decreasing the supply of fuel and air mixture to the combustion chamber.

In one embodiment, when the throttle wire 255 is fully released, the outer cylinder 270 is pushed downwards by the spring 245. In one embodiment, the outer cylinder 270 reaches an original position (fully closed state as in FIG. 5), in which the nozzles 260 of inner cylinder 225 are entirely closed and air flow is restricted near mixing region 225. Further, the supply of fuel and air mixture is restricted to the combustion chamber. Also, the combustion chamber reduces the ignition of fuel and air mixture. Further, the availability of fuel and air mixture at combustion chamber may eventually become nil, the ignition is stopped and the engine may attain "OFF" state automatically.

While various examples of the present disclosure have been described above, it should be understood that they have been presented by way of example, and not limitation. Thus, the breadth and scope of the present disclosure should not be limited by any of the above-described examples, but should be defined in accordance with the following claims and their equivalents.

What is claimed is:

1. A carburetor comprising:

a hollow inner cylinder having plurality of nozzles formed on a cylindrical surface, wherein the nozzles provide a flow path for a fuel to flow from a hollow region inside the cylindrical surface to outside of the cylindrical surface of the inner cylinder;

a hollow outer cylinder placed on the inner cylinder wherein the axis of the inner cylinder and the outer cylinder coincide; and a mechanism for sliding the outer cylinder over the inner cylinder, wherein a number of nozzles through which the fuel flows out increases when the outer cylinder slides in a first direction and decreases when the outer cylinder slides in a second direction opposite to the first direction.

2. The carburetor of claim 1, wherein in the inner cylinder is placed in a first region such that air is sucked into a combustion chamber from an air passage through the first region.

3. The carburetor of claim 2, wherein opening of the air passage to the first region increases when the outer cylinder is moved in the first direction and decreases when moved in the second direction.

4. The carburetor of claim 3, further comprising a throttle control coupled to the outer cylinder, operative to control power of an engine employing the carburetor, wherein increasing the throttle moves the outer cylinder in the first direction and decreasing the throttle moves the outer cylinder in the second direction.

5. The carburetor of claim 4, further comprising a mixing chamber to mix air to the fuel flown out of the nozzles to form a fuel air mixture and a venturi coupled to the combustion chamber of the engine and the first region, wherein the fuel air mixture is sucked from the first region into the combustion chamber during a suction cycle of the engine.

6. The carburetor of claim 5, wherein the number of nozzles through which the fuel flows out decreases when the outer cylinder slides in the second direction.

7. The carburetor of claim 6, further comprising a casing housing the inner cylinder and the outer cylinder, and a spring coupled to the outer cylinder, wherein the spring pushes the outer cylinder in the second direction.

8. The carburetor of claim 7, wherein the spring in its maximum expanded state holds the outer cylinder at a first position closing all the nozzles and the air passage.

9. The carburetor of claim 8, wherein the inner cylinder is stationary and rigidly fixed to the casing within the casing.

10. A method of controlling a flow of fuel into a combustion chamber of a carburetor in proportion to a level of throttle comprising:

allowing fuel to flow through a first number of nozzles into the combustion chamber;

adjusting the first number of nozzles in accordance with the level of throttle; and moving a first cylindrical surface closely over an array of nozzles such that the first number of nozzles are uncovered and a second number of nozzles are covered by the first cylindrical surface, in that the array of nozzles are formed on a second cylindrical surface, wherein the first cylindrical surface and the second cylindrical surface are coupled such that the first cylindrical surface slides over the second cylindrical surface.

11. The method of claim 10, further comprising controlling an inflow of air by the first cylindrical surface such that the inflow of air is zero when the first number is zero and the inflow of air is maximum when the value of first number is maximum.

12. The method of claim 11, wherein the movement of the first cylindrical surface is coupled to a throttle control mechanism.

* * * * *